US006382428B2

(12) United States Patent
Hurwitz

(10) Patent No.: US 6,382,428 B2
(45) Date of Patent: May 7, 2002

(54) NOTEPAD AND NOTEPAD HOLDER COMBINATION

(76) Inventor: Trevor Hurwitz, Dept. of Psychiatry, UBC Hospital, 2255 Westbrook Mall, Vancouver, British Columbia (CA), V6T 2A1

( * ) Notice: Subject to any disclaimer, the term of this patent is extended or adjusted under 35 U.S.C. 154(b) by 0 days.

(21) Appl. No.: 09/764,416

(22) Filed: Jan. 19, 2001

Related U.S. Application Data

(63) Continuation-in-part of application No. 09/537,762, filed on Mar. 30, 2000, now abandoned.

(51) Int. Cl.[7] ..... B42F 1/00
(52) U.S. Cl. ..... 211/50
(58) Field of Search ..... 211/50; D19/86

(56) References Cited

U.S. PATENT DOCUMENTS 4,444,319 A 4/1984 Sharber
4,884,353 A * 12/1989 Taylor ..... 40/611
5,100,178 A 3/1992 MacKelvie
D358,846 S 5/1995 Kirchhoff et al.
5,427,254 A 6/1995 Knieriem
5,480,037 A 1/1996 Pope

* cited by examiner

*Primary Examiner*—Daniel P. Stodola
*Assistant Examiner*—Erica B. Harris

(57) ABSTRACT

A notepad having rectangular leaves each having a self-adhesive marginal edge portion adhered to an underlying leaf, and a free edge opposite from the marginal edge portion, is provided in a notepad holder having a rectangular pad support surface, a pair of opposed site walls extending at right angles to the pad support surface at opposite sides of the pad support surface and an abutment for the marginal edge portions. Resilient material, secured to the side walls, is in contact with and compressed by opposite sides of the notepad. At least the lowermost one of the leaves folded to form a strip-shaped bulge and a plastic strip is inserted into the bulge to increase the retention of the notepad.

24 Claims, 7 Drawing Sheets

NOTEPAD AND NOTEPAD HOLDER COMBINATION

CROSS-REFERENCE TO RELATED APPLICATION

This is a continuation-in-part of Patent Application No.09/537,762, filed Mar. 30, 2000 and now abandoned.

BACKGROUND OF THE INVENTION

1. Field of the Invention

The present invention relates to a notepad and notepad holder combination, and more particularly is useful for notepads of the type comprising leaves each provided with an adhesive on a marginal edge portion, whereby the leaves are releasibly secured to one another along these marginal edge portions.

2. Description of the Related Art

It has previously been proposed, in U.S. Pat. No. 5,427,254, issued Jun. 27, 1995 to Gustave Knieriem, to provide a holding device for self-stick notepads using the one or more hook and loop, two-sided adhesive or other fasteners to position a self-stick notepad in a dispenser. The fastener is connected between the spine of the notepad and a wall of the dispenser to hold the notepad within the dispenser.

More particularly, a strip of fastener material is attached to the notepad, along the spine of the notepad, and co-operates with a strip of fastener material on the wall of the holder.

Therefore, this prior arrangement has the disadvantage that the dispenser cannot be employed with a conventional notepad and it is instead necessary to modify a conventional notepad by attaching a strip of the fastener material along the spine of the notepad.

In addition, it is proposed, in this prior patent, to provide a further strip of fastener material along one of a pair of side walls of the dispenser for frictional engagement with one side of the notepad in order to thereby retain the notepad in the dispenser.

BRIEF SUMMARY OF THE INVENTION

According to the present invention, there is provided a notepad in combination with a notepad holder, the notepad comprising rectangular leaves each having a marginal edge portion, an adhesive on the marginal edge portion securing the leaf to an underlying leaf, and a free edge opposite from the marginal edge portion. The notepad holder comprises an open-sided tray structure comprising a base, a rectangular support surface on the base and walls extending at right angles to the pad support surface. The walls extend along three edges of a pad support surface and comprise a pair of opposed side walls and a third wall extending between the side walls. The notepad is mounted on the pad support surface, with the marginal edge portions adjacent the third wall, and a pair of strips of resilient material secured to the side walls are in contact with and are compressed by opposite sides of the notepad, whereby the notepad is releasibly frictionally retained in the tray structure. An elongate raised portion is located beneath the pad at a spacing from the free edges of the leaves.

When this combination is in use, by pressing a finger onto the notepad, between the raised portion and the third wall, the shape of the notepad can be deformed slightly, by bending the notepad into a shallow U-shape, as viewed in side view, so that the free edges of the leaves are thereby fanned slightly apart from one another. This fanning of the free edges of the leaves facilitates deflection by the thumb or finger of the user of the free edge of the uppermost leaf of the pad from the remaining leaves, so that the uppermost leaf can therefore readily be gripped and thereby stripped from the pad.

As the leaves are stripped, one at a time, from the notepad, it is necessary to ensure that the notepad is not thereby dislodged from its position on the pad support surface by the force that is required to strip each leaf from its adjacent leaf against the adhesive effect.

The present inventor has found that this problem can be substantially mitigated or even entirely overcome by providing, on each of the side walls a resilient material that is compressed between that sidewall and an opposed side of the notepad. Such compression of these strips of resilient material exerts a frictional retaining force on the side edges of the leaves of the notepad, which resists movement of the notepad away from the pad support surface.

The dislodging of the notepad from the pad support surface becomes more and more problematical as the notepad is used up and, consequently, has fewer and fewer leaves remaining in the notepad holder. Eventually, when only a very few leaves are left in the holder, there is an increased risk that removal of the uppermost one of these leaves will dislodge the remainder.

The present inventor has found that this problem can be substantially overcome by folding the leaves which are located closest to the pad support surface. More particularly, by e.g. folding in half, and then in half again, the lowermost one or more of the leaves of the notepad, to form a strip-shaped elongate bulge which underlies the marginal edge portions of the remainder of the leaves, the retention of the remainder of the leaves of the notepad in the notepad holder is considerably facilitated.

The advantageous effect of this bulge can be increased by providing an insert, e.g. in the form of a strip of flexible plastic material, in the bulge so that opposite ends of this strip press, at opposite sides of the notepad, against the resilient material to increase the retention of the lowermost leaf of the notepad.

BRIEF DESCRIPTION OF THE DRAWINGS

The present invention will be more readily understood from the following description of preferred embodiments thereof given, by way of example, with reference to the accompanying drawings, in which.

DESCRIPTION OF THE PREFERRED EMBODIMENTS

Figure 1:
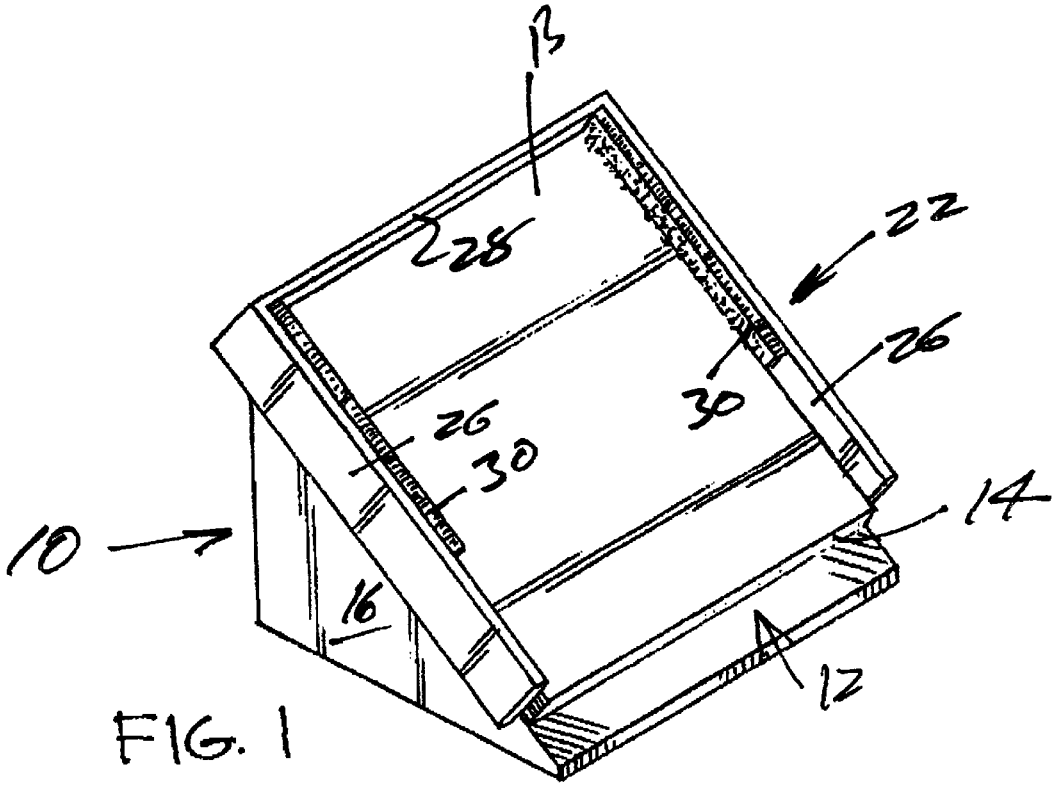
FIG. 1 shows a view in perspective of a notepad installed in a notepad holder, FIG. 2 to shows a view in perspective, corresponding to that of FIG. 1, but with the notepad omitted from the notepad holder.
Figure 2:
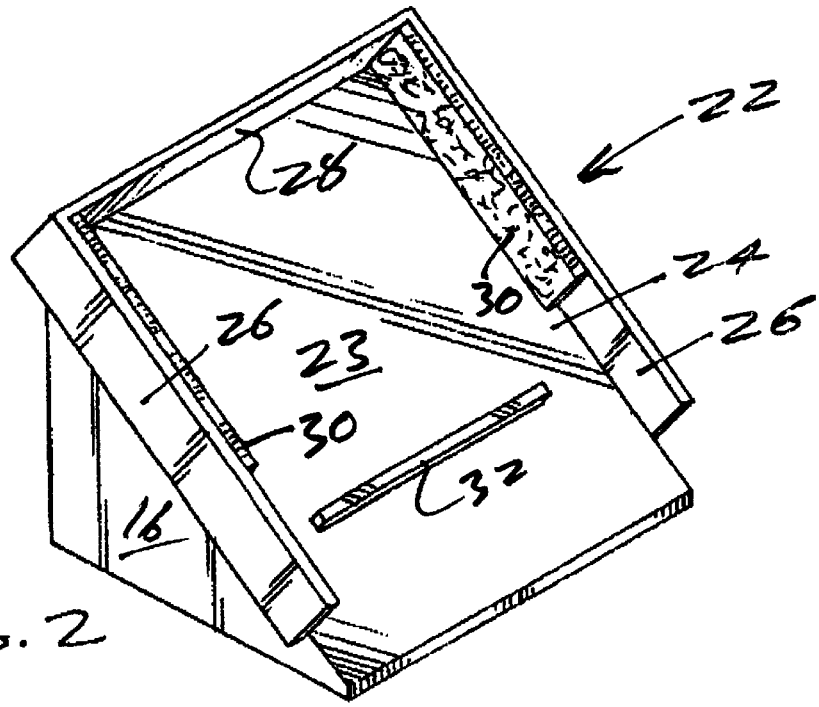

In FIG. 1 of the accompanying drawings, there is illustrated a notepad holder that is indicated generally by reference numeral 10 and which contains a notepad indicated generally by reference numeral 12.

Figure 3:
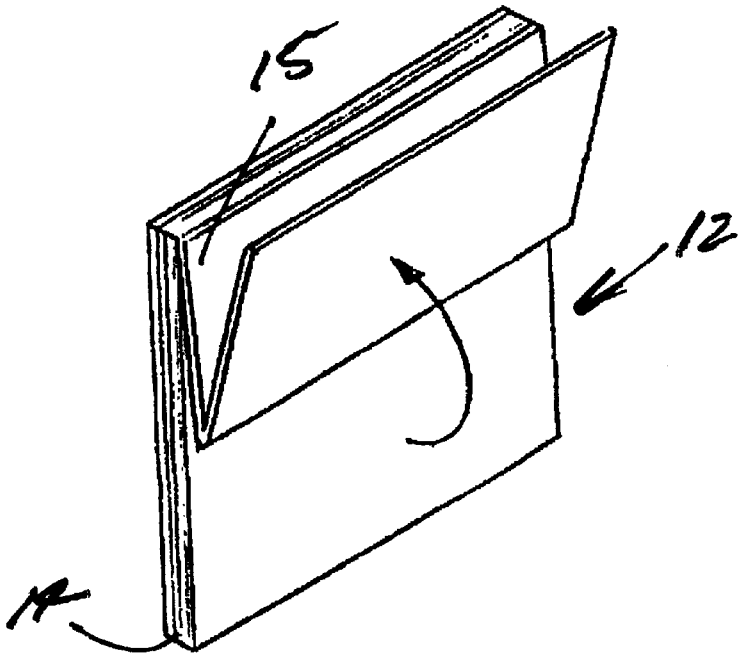
FIG. 3 shows a view in perspective of the notepad of FIG. 1 being prepared for insertion into the notepad holder of FIGS. 1 and 2.

The notepad 12 is a conventional notepad comprising self-stick leaves, each provided with a marginal edge portion 13 on which there is a layer of adhesive for releasibly securing each leaf to the underlying leaf. The lowermost leaf, indicated by reference numeral 15 in FIG. 3, is thicker and stronger than the rest of the leaves. Such notepads are well known and, therefore, the notepad 12 is not further described herein, except to mention that it has free edges 14 opposite from the adhered marginal edge portions 13.

The notepad holder 10 comprises a base formed by a pair of triangular side walls 16, only one of which is shown, a rectangular rear wall 20 (FIG. 5) and a rectangular bottom 21, and a tray structure, indicated generally by reference numeral 22, which is mounted at an inclination on this base.

The tray structure 22 comprises a rectangular base 23 presenting a rectangular pad support surface 24, opposed side walls 26 at opposite sides of the pad support surface 24 and a notepad abutment on the form of a third or rear wall 28 extending between the side walls 26. The walls 26 and 28 extend along three edges of the pad support surface 24, and the tray structure is open at the side of the pad support surface 24 opposite from the wall 28. The pad support surface 24 is upwardly inclined from this open side to the third wall 28.

The side walls 26 are provided with opposed pad retaining pieces, in the form of strips 30, of resilient material. This resilient material should grip the notepad 12 in such a way as to allow easy insertion and removal of the notepad 12 between and from the resilient material retaining strips 30 without damage to the individual leaves of the notepad 12. The present inventor has found that a loop portion of a hook and loop fastener material is particularly suitable for this purpose.

A raised portion in the form of a rib 32 extends transversely across the pad support surface 24, between the opposed side walls 26, and is parallel to and spaced from the rear wall 28. More particularly, the rib 32 is located beneath the notepad 12, when the notepad 12 is installed in the holder 10, at a spacing from the free edges 14 of the leaves.

Figure 4:
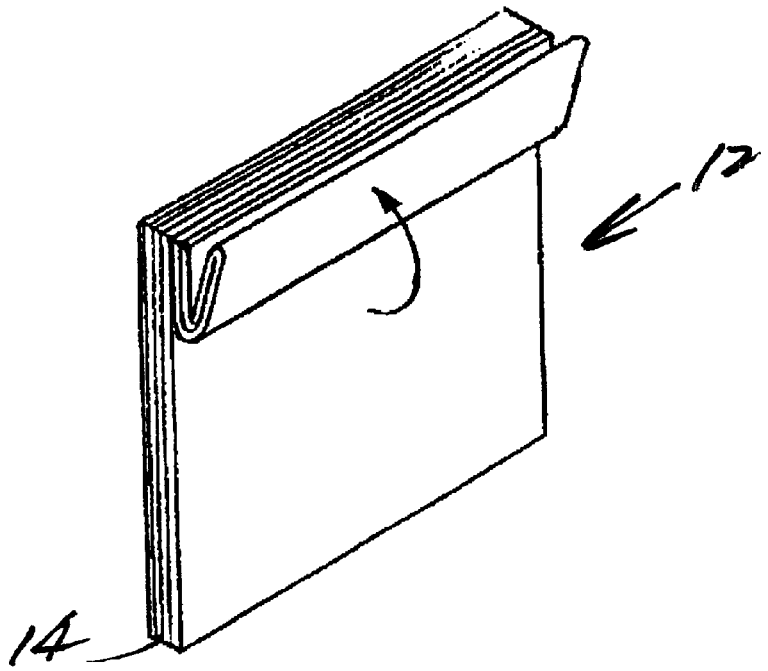
FIG. 4 shows a view in perspective of the notepad, corresponding to that of FIG. 3, but with the preparation of the notepad in a more advanced stage.
Figure 5:
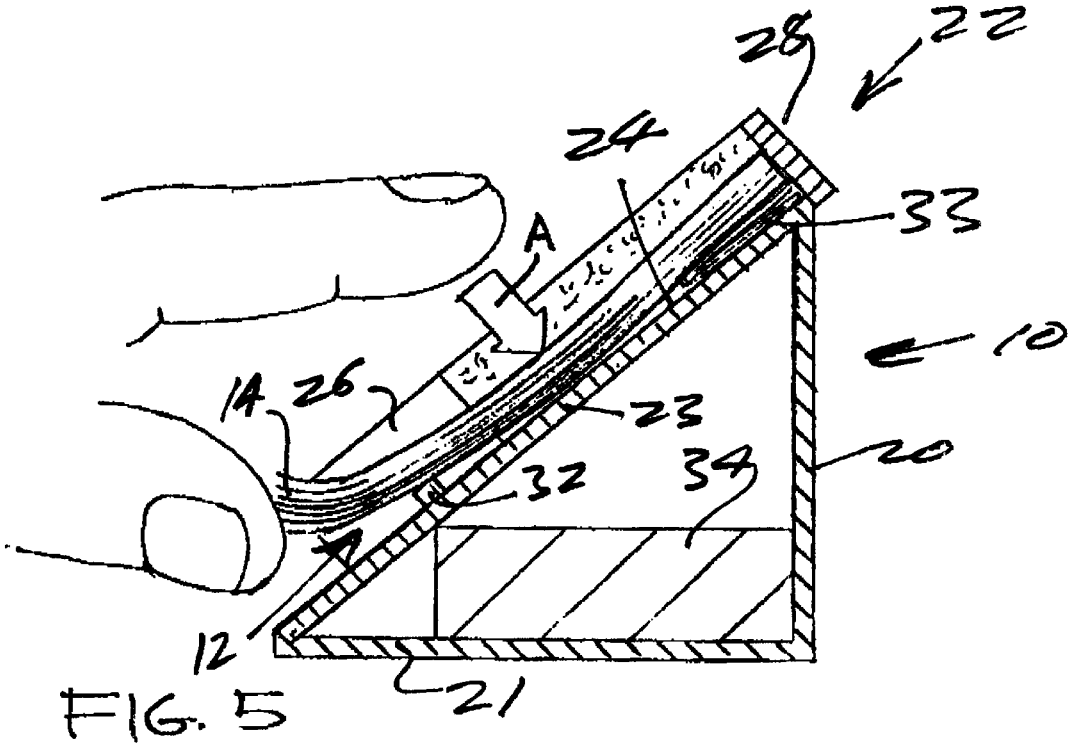
FIG. 5 shows a view in vertical cross-section through the notepad and notepad holder of FIG. 1 during removal of a leaf from the notepad.

Before being installed in the notepad holder 10, the notepad 12 is adapted as shown in FIGS. 3 and 4. As shown in these figures, at least the lowermost or bottom leaf 15, and preferably at least two of the lowermost leaves, is or are firstly folded in half, as shown in FIG. 3, and then in half again, as shown in FIG. 4, so that these folded leaves form an elongate strip-shaped bulge, indicated by reference numeral 33 in FIG. 5, which underlies the adhesive marginal edge portions of the remainder of the leaves and is located adjacent the wall 28 and between the remainder of the leaves and the pad support surface 24, as shown in FIG. 5. Opposite ends of the bulge 33 press against the retaining strips 30 to ensure retention of the lowermost leaf 15 as the notepad 12 becomes depleted.

Figure 6:
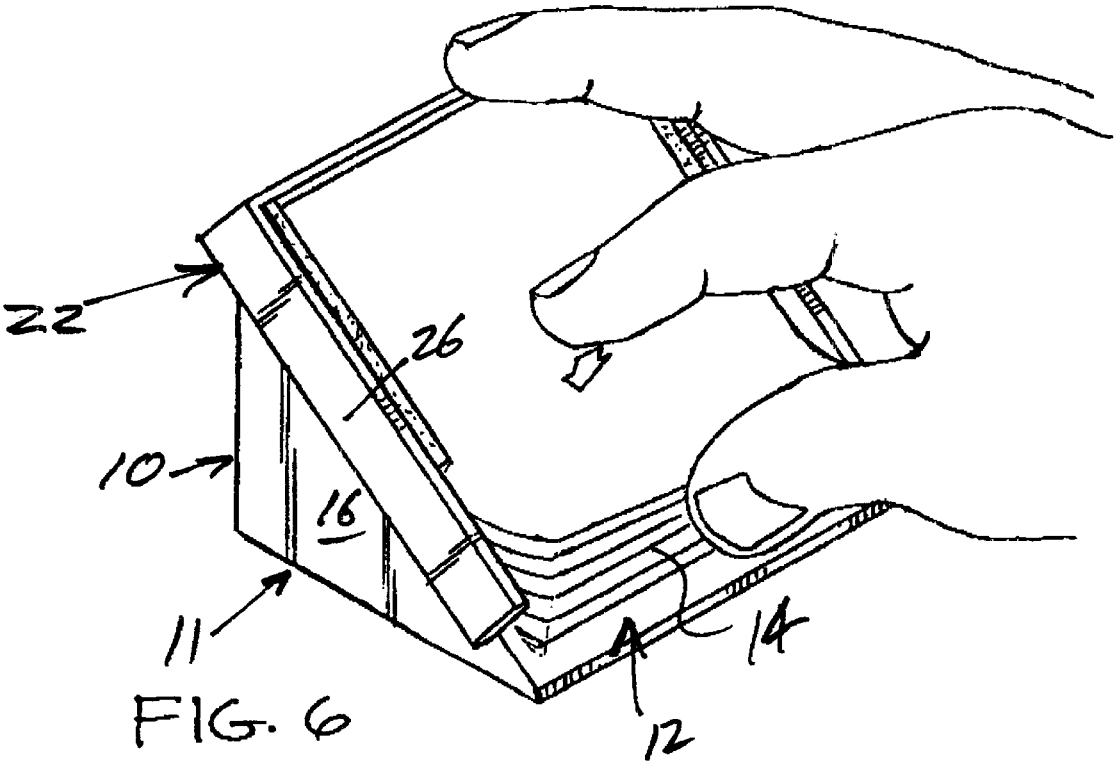
FIG. 6 shows a view in perspective of the notepad and the notepad holder during the removal of a leaf.

The purpose of the rib 32 is to facilitate stripping of the leaves one at a time from the notepad 12. For this purpose, as illustrated in FIG. 5, the user firstly exerts a pressure on the notepad 12, as indicated by an arrow A in FIG. 5, so as to bend the notepad 12 into a very shallow U-shape. This causes the free edges 14 of the leaves to be fanned apart from one another, as shown in FIGS. 5 and 6, so that they can readily be grasped and removed, one at a time, for example by the user's thumb and/or forefinger.

As the notepad 12 becomes more and more depleted, and only a few leaves remain, the retention of these remaining leaves by the frictional effect of the opposed retaining strips 30 is facilitated by the somewhat more secure gripping of the opposite ends of the bulge 33 by these opposed retaining strips 30.

If required, a weight 34 of, for example, lead may be provided within the base of the holder 10 to hold the holder down on a support surface, for example a table or a desk (not shown) during the removal of the leaves of the notepad 12.

Figure 7:
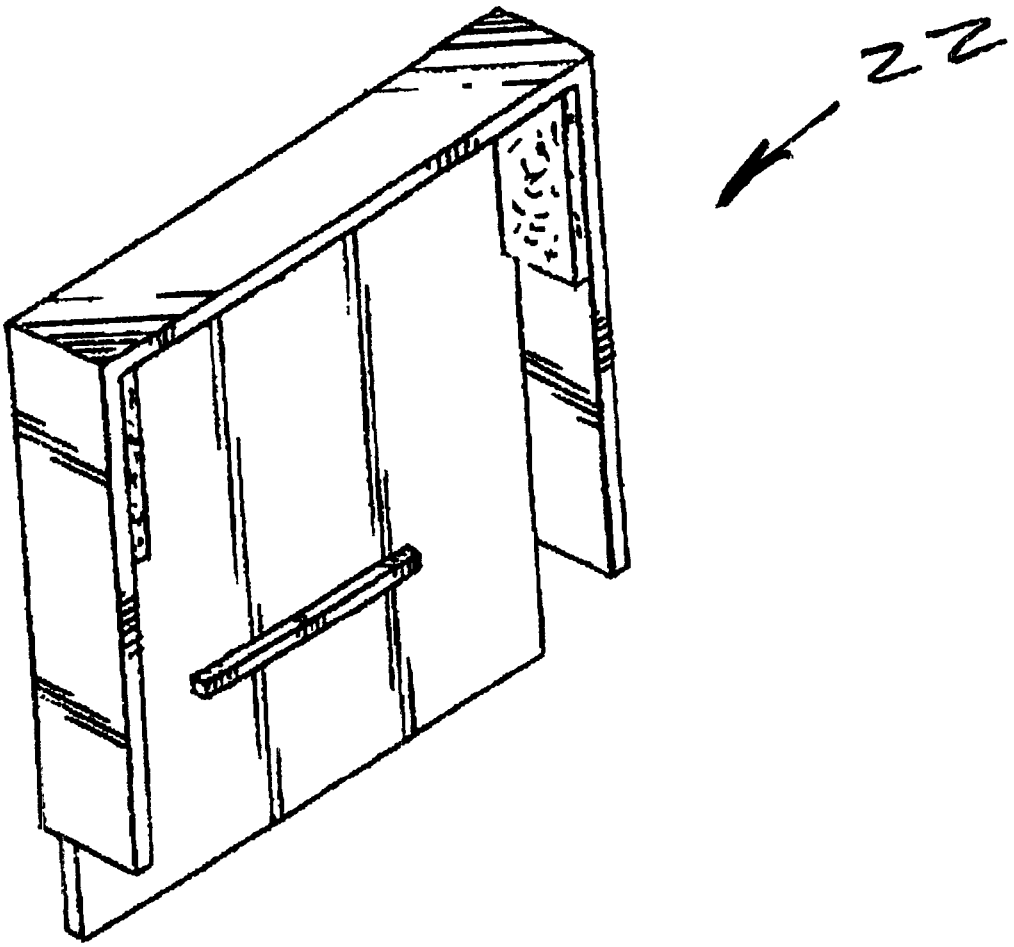
FIG. 7 shows a view in perspective of the notepad holder oriented for attachment to a vertical surface.

However, as shown by the embodiment of the invention illustrated in FIG. 7, the base 11 of the notepad holder 10 may be omitted entirely to enable the tray structure 22 to be used in an orientation such that the base of the tray structure 22 extends vertically for attachment to a vertical support surface (not shown), in which case an adhesive, or an adhesive strip of material (not shown) may be provided at the rear of the tray structure 22 for securing the tray structure 22 to this vertical support surface.

Figure 9:
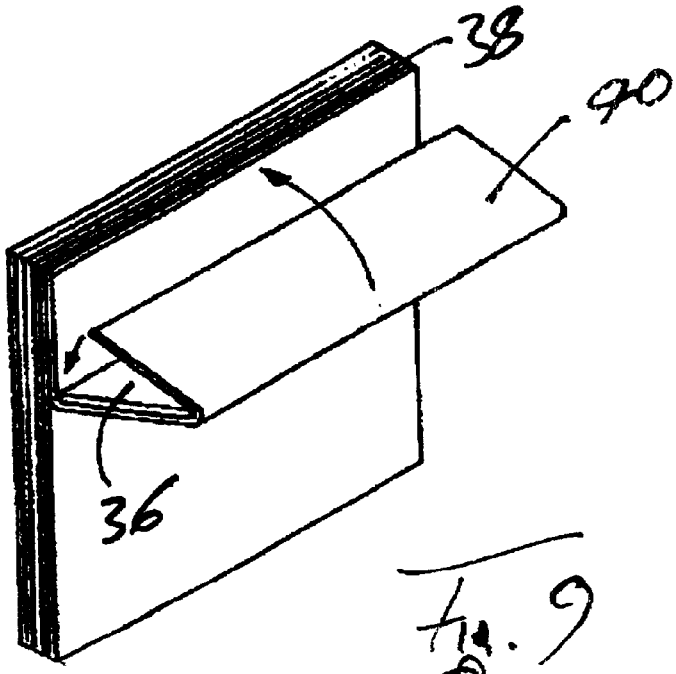
FIG. 9 shows a view in perspective corresponding to that of FIG. 8, but illustrating a step of folding insert into one of the leaves of the pad to form a bulge.
Figure 10:
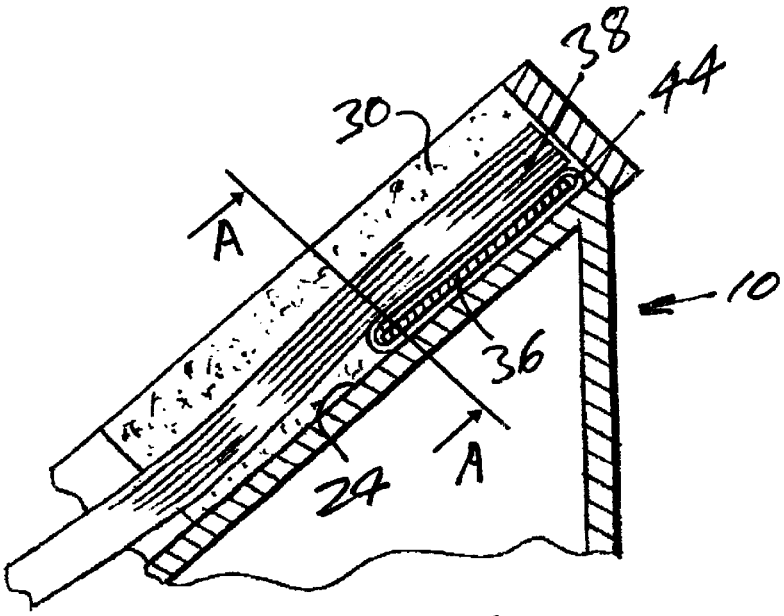
FIG. 10 shows a view in cross-section, corresponding to that of FIG. 5, but showing the insert folded into the lowermost leaf of the notepad.

The above-described retention of the lowermost leaf 15 by the action of the retaining strips 30 on the opposite ends of the bulge can be increased by providing an insert 36 in the form of a strip of flexible plastic material in the bulge formed by the folded lowermost one or more of the leaves of the notepad, as illustrated in FIGS. 9 through 10.

More particularly, the insert 36 has a width W which is slightly less than one third of the height or top-to-bottom dimension H of the leaves of the notepad, which in this embodiment of the invention is indicated by reference numeral 38 and which is identical to the notepad 12. The length L of the insert 36 is slightly greater than that of the notepad 38 to correspondingly increase the frictional grip of the resilient material retaining strips 30 on the insert 36.

Figure 8:
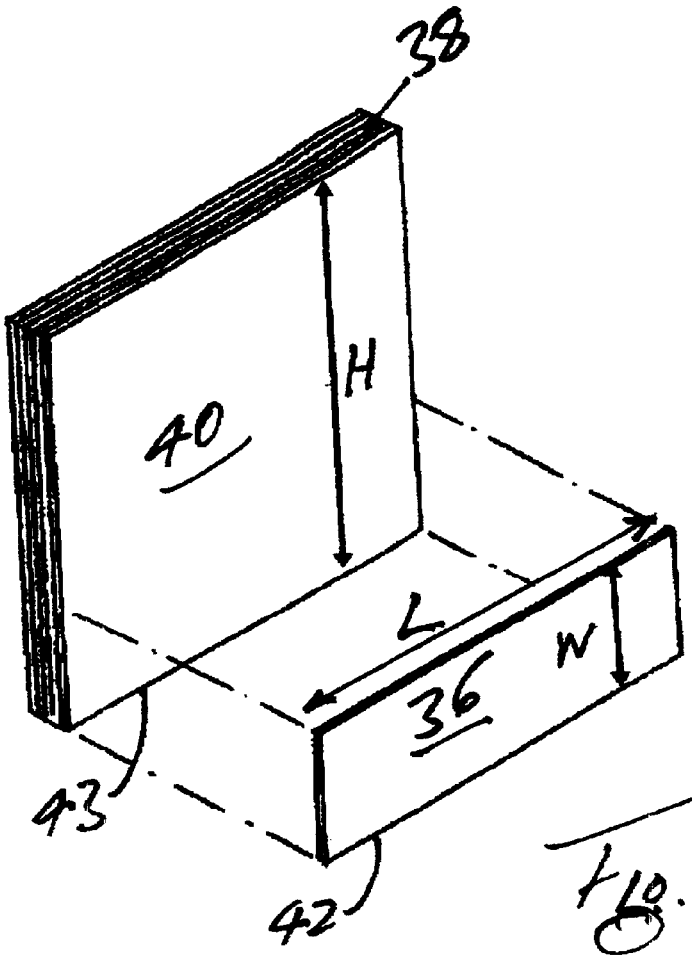
FIG. 8 shows a view in perspective of a notepad provided with a strip-shaped bulge insert.

As shown in FIG. 8, the insert 36 is moved against a leaf 40 of the notepad 38 with a lowermost longitudinal edge 42 of the insert 36 extending along or closely parallel to a lowermost edge 43 of the leaf 40.

The insert 36 is then wrapped in the lowermost leaf 40 of the notepad 38, by flipping the insert 36 over at its two longitudinal edges, as shown in FIG. 9, so that the leaf 40 becomes folded around the insert 36 to form a bulge 44. As shown in FIG. 10, the bulge 44 extends between the notepad 38 and the support surface 24 of the notepad holder 10 in the same position relative to the notepad 38 as was the case with the bulge 33 of FIG. 5 relative to the notepad 12.

When the notepad 38, thus provided with the insert 36 in the bulge 44, is installed in the notepad holder 10, opposite ends 46 of the insert 36 press against the resilient retaining strips 30, so that the retention of the lowermost leaf 40 relative to the notepad holder 10 on depletion of the notepad 38 is thereby increased.

Figure 11:
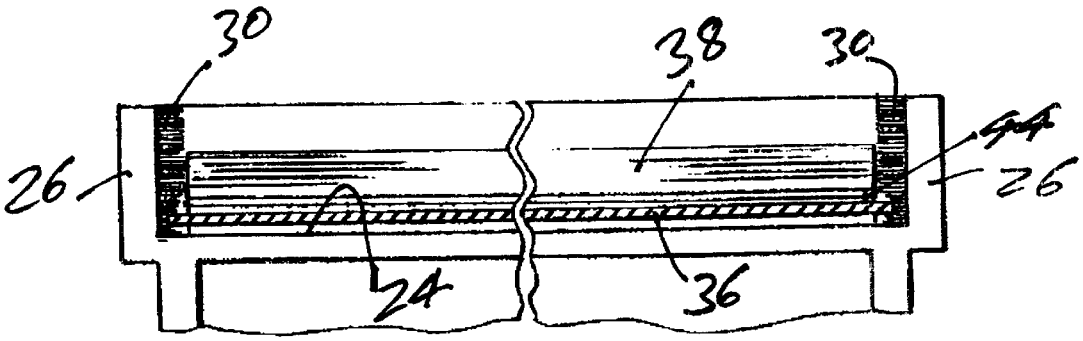
FIG. 11 shows a view taken in section along the line 10—10 of FIG. 9.
Figure 12:
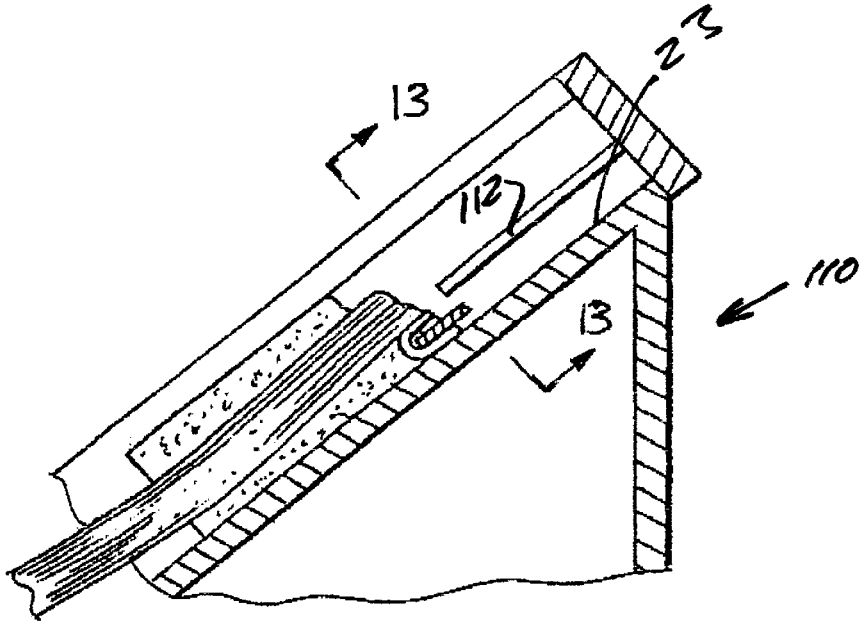
FIG. 12 shows a view corresponding to that of FIG. 5 but taken in cross-section through a modification of the notepad holder of FIGS. 1 through 6.
Figure 13:
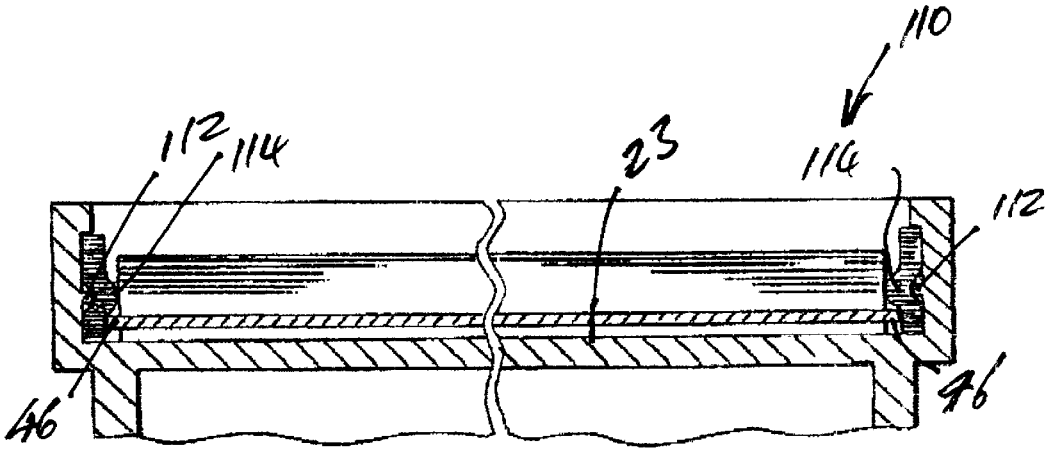
FIG. 13 shows a broken-away view taken in cross-section along the line 13–13 of FIG. 12.

FIGS. 12 and 13 illustrate a holder, indicated generally by reference numeral 110, that is a modification of the holder 10 of FIGS. 10 and 11 and, for convenience, parts of the holder 110 of FIGS. 12 and 13, which are similar to those to the holder 10 of FIGS. 10 and 11, are indicated by the same reference numerals.

The holder 110 differs from the holder 10 by the provision of projections 112 on the opposed faces of the side walls 26. These projections 112 are in the form of linear ribs extending parallel to and spaced from the pad support surface 23, and form in the retaining strips 30 a pair of bulges 114, which overlie the opposite ends 46 of the insert 36 so as to increase the retention of the insert 36 in the holder 110. As can be seen in FIG. 13, the ends 46 of the insert 36 project laterally slightly beyond the notepad from the lowermost leaf which is folded around the insert 36.

As will be apparent to those skilled in the art, various modifications may be made to the above-described embodiments of the invention within the scope of the accompanying claims.

I claim:

1. In combination, a notepad and a notepad holder, said notepad comprising rectangular leaves and said leaves each having a marginal edge portion adhered to an underlying leaf, and a free edge opposite from said marginal edge portion, and said notepad holder comprising a notepad receptacle, said notepad receptacle comprising a rectangular pad support surface and a pair of opposed side walls extending at right angles to said pad support surface at opposite sides of said pad support surface and an abutment, said notepad being mounted on said pad support surface with said marginal edge portions against said abutment, a pair of retaining pieces of resilient material secured to said side walls, respectively, said retaining pieces being in contact with and being compressed by opposite sides of said notepad, whereby said notepad is resiliently frictionally retained in said receptacle, and an elongate raised portion extending across said pad support surface between and at right angles to said side walls, said raised portion being located beneath said pad and spaced from said abutment and from said free edges of said leaves.

2. A combination as claimed in claim 1, wherein said notepad includes at least two folded leaves adjacent said pad support surface, said leaves each being folded beneath said marginal edge portions of the remainder of said leaves and forming an elongate bulge and said elongate bulge having opposite ends in contact with said retaining pieces.

3. A combination as claimed in claim 1, wherein said raised portion comprises a rib projecting from said pad support surface.

4. A combination as claimed in claim 1, wherein said resilient material comprises a loop portion of a hook and loop fastener material.

5. A combination as claimed in claim 1, wherein said abutment comprises a third wall extending between said side walls, said receptacle having an open side opposite from said third wall.

6. A combination as claimed in claim 5, wherein said receptacle is provided on a base and said pad support surface is inclined upwardly from said open side to said third wall.

7. In combination, a notepad and a notepad holder, said notepad comprising rectangular leaves and said leaves each having a marginal edge portion adhered to an underlying leaf, and a free edge opposite from said marginal edge portion, and said notepad holder comprising a notepad receptacle, said notepad receptacle comprising a rectangular pad support surface, a pair of opposed side walls extending at right angles to said pad support surface at opposite sides of said pad support surface and an abutment, said notepad being mounted on said pad support surface with said marginal edge portions against said abutment, and a pair of retaining pieces of resilient material secured to said side walls, respectively, said retaining pieces being in contact with and being compressed by opposite sides of said notepad, whereby said notepad is resiliently frictionally retained in said receptacle, at least one of said leaves being folded to form a strip-shaped bulge located beneath said marginal edge portions of the remainder of said leaves and in proximity to said pad support surface, and said bulge having opposite ends in contact with said retaining pieces to increase the retention of said notepad.

8. A combination as claimed in claim 7, further comprising an insert extending along said bulge, said at least one of said leaves being folded around said insert and said insert having opposite ends pressing against said retaining pads to increase the retention of said notepad.

9. A combination as claimed in claim 8, wherein said insert is of flexible material.

10. A combination as claimed in claim 8, wherein said insert is strip-shaped.

11. A combination as claimed in claim 8, including projections extending from said side walls towards said notepad and forming bulges in said retaining pieces, said bulges overlying opposite ends of said insert.

12. A combination as claimed in claim 11, wherein said opposite ends of said insert project laterally of said notepad beyond said at least one of said leaves.

13. A combination as claimed in claim 12, wherein said projections comprise linear ribs parallel to and spaced from said pad support surface.

14. A combination as claimed in claim 11, wherein said receptacle is provided on a base and said pad support surface is inclined upwardly from said open side to said third wall.

15. A combination as claimed in claim 7, wherein said insert is a strip of plastic material.

16. A combination as claimed in claim 7, wherein said abutment comprises a third wall extending between said side walls, said receptacle having an open side opposite from said third wall.

17. In combination, a notepad and a notepad holder, said notepad comprising rectangular leaves and said leaves each having a marginal edge portion adhered to an underlying leaf, and a free edge opposite from said marginal edge portion, and said notepad holder comprising a notepad receptacle, said notepad receptacle comprising a rectangular pad support surface and a pair of opposed side walls extending at right angles to said pad support surface at opposite sides of said pad support surface and an abutment, said notepad being mounted on said pad support surface with said marginal edge portions against said abutment, a pair of retaining pieces of resilient material secured to said side walls, respectively, said retaining pieces being in contact with and being compressed by opposite sides of said notepad, whereby said notepad is resiliently frictionally retained in said receptacle, and an elongate raised portion extending across said pad support surface between and at right angles to said side walls, said raised portion being located beneath said pad and spaced from said abutment and from said free edges of said leaves at least one of said leaves being folded to form a strip-shaped bulge located beneath said marginal edge portions of the remainder of said leaves and adjacent said pad support surface, said bulge having opposite ends in contact with said retaining pieces to increase the retention of said notepad.

18. A combination as claimed in claim 17, further comprising an insert extending along said bulge, said at least one of said leaves being folded around said insert and said insert having opposite ends pressing against retaining pads to increase the retention of said notepad.

19. A combination as claimed in claim 18, wherein said insert is strip-shaped.

20. A combination as claimed in claim 18, wherein said insert is a strip of plastic material.

21. A combination as claimed in claim 18, wherein said notepad includes at least two folded leaves adjacent said pad support surface, said leaves each being folded beneath said marginal edge portions of the remainder of said leaves.

22. A combination as claimed in claim 18, wherein said raised portion comprises a rib projecting from said pad support surface.

23. A combination as claimed in claim 18, wherein said resilient material comprises a loop portion of a hook and loop fastener material.

24. A combination as claimed in claim 18, wherein said insert is of flexible material.

* * * * *